US011168684B2

(12) United States Patent
Saga et al.

(10) Patent No.: US 11,168,684 B2
(45) Date of Patent: Nov. 9, 2021

(54) VARIABLE DISPLACEMENT PUMP

(71) Applicant: HITACHI AUTOMOTIVE SYSTEMS, LTD., Hitachinaka (JP)

(72) Inventors: Koji Saga, Ebina (JP); Hideaki Ohnishi, Atsugi (JP); Yasushi Watanabe, Kanagawa (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 199 days.

(21) Appl. No.: 16/082,242

(22) PCT Filed: Feb. 6, 2017

(86) PCT No.: PCT/JP2017/004185
§ 371 (c)(1),
(2) Date: Sep. 4, 2018

(87) PCT Pub. No.: WO2017/154438
PCT Pub. Date: Sep. 14, 2017

(65) Prior Publication Data

US 2020/0032793 A1 Jan. 30, 2020

(30) Foreign Application Priority Data

Mar. 7, 2016 (JP) ..... JP2016-042943

(51) Int. Cl.
*F04C 14/22* (2006.01)
*F04C 2/344* (2006.01)
(Continued)

(52) U.S. Cl.
CPC ..... *F04C 14/226* (2013.01); *F04C 2/344* (2013.01); *F04C 2/3442* (2013.01);
(Continued)

(58) Field of Classification Search
CPC ..... F04C 14/226; F04C 2/3442; F04C 2/344; F04C 14/223; F04C 2270/185; F04C 2210/206; F04C 15/06
See application file for complete search history.

(56) References Cited

U.S. PATENT DOCUMENTS 10,161,398 B2 * 12/2018 Saga ..... F01M 1/02
2014/0147322 A1 * 5/2014 Saga ..... F04C 2/344 418/24

(Continued)

FOREIGN PATENT DOCUMENTS

JP 2000-104671 A 4/2000
JP 2012-122389 A 6/2012

(Continued)

*Primary Examiner* — Peter J Bertheaud
(74) *Attorney, Agent, or Firm* — Foley & Lardner LLP

(57) ABSTRACT

Variable displacement pump has first control hydraulic chamber 21 giving force to cam ring 5 in direction that decreases volume variation of each pump chamber 13 by internal pressure, second control hydraulic chamber 22 giving force to cam ring in direction that increases volume variation of each pump chamber by internal pressure, first seal surface 44 formed on both end surfaces of cam ring, which are in sliding-contact with both opposing inside surfaces of pump body 1 and cover member 2, and sealing gap between each pump chamber and first control hydraulic chamber, and second seal surface 45 sealing gap between each pump chamber and second control hydraulic chamber at outlet section side. Radial direction width W2 of second seal surface is greater than that W1 of first seal surface. Increase in weight of the pump can be suppressed while suppressing increase in pump control pressure against intention of control.

14 Claims, 8 Drawing Sheets

(51) Int. Cl.

| | |
|---|---|
| ***F04C 15/06*** | (2006.01) |
| ***F01M 1/02*** | (2006.01) |
| ***F04C 15/00*** | (2006.01) |

(52) U.S. Cl.

CPC ..... *F04C 14/223* (2013.01); *F04C 15/06* (2013.01); *F01M 2001/0238* (2013.01); *F04C 15/003* (2013.01); *F04C 2210/206* (2013.01); *F04C 2270/185* (2013.01)

(56) References Cited

U.S. PATENT DOCUMENTS

| | | | |
|---|---|---|---|
| 2015/0252803 | A1 | 9/2015 | Ohnishi et al. |
| 2017/0030351 | A1 | 2/2017 | Saga |

FOREIGN PATENT DOCUMENTS

| | | | |
|---|---|---|---|
| JP | 2014-105622 | A | 6/2014 |
| WO | WO-2014-038302 | A1 | 3/2014 |
| WO | WO-2014/141013 | A1 | 9/2014 |

* cited by examiner

VARIABLE DISPLACEMENT PUMP

TECHNICAL FIELD

The present invention relates to a variable displacement pump applied to a hydraulic pressure source that supplies working fluid to, for instance, sliding parts in an internal combustion engine of a vehicle.

BACKGROUND ART

As a related-art variable displacement pump applied to the internal combustion engine of the vehicle, there has been known a variable displacement pump disclosed in the following Patent Document 1.

This variable displacement pump is configured so that a first control hydraulic chamber and a second control hydraulic chamber are each defined between an inner circumferential surface of a pump housing and an outer circumferential surface of a cam ring, and further by a pump discharge pressure being supplied to the first control hydraulic chamber, the cam ring is forced in a direction (hereinafter, called a concentric direction) in which an eccentric amount of the cam ring becomes small, while by the pump discharge pressure being supplied to the second control hydraulic chamber, the cam ring is forced in a direction (hereinafter, called an eccentric direction) in which the eccentric amount of the cam ring becomes large. Further, a coil spring forces the cam ring so as to increase the eccentric amount in the eccentric direction by a spring force of the coil spring in cooperation with the working fluid in the second control hydraulic chamber.

Furthermore, each internal pressure of a plurality of pump chambers that are defined by a plurality of vanes extending and retracting from an outer circumferential surface of a rotor in a radial direction and an inner circumferential surface of the cam ring also contributes to a rocking control (or a movement control) of the cam ring in eccentric/concentric directions.

Moreover, by controlling supply and discharge of the pump discharge pressure to and from the second control hydraulic chamber by an electromagnetic switching valve and a pilot valve, the eccentric amount of the cam ring is controlled in accordance with an engine rotation speed, and by controlling a required discharge pressure at two levels of low and high pressure characteristics, supply of oil to a plurality of devices can be possible.

CITATION LIST

Patent Document

Patent Document 1: Japanese Unexamined Patent Publication No. JP2014-105622

SUMMARY OF THE INVENTION

Technical Problem

In the related-art variable displacement pump, the plurality of pump chambers and the first and second control hydraulic chambers are sealed by so-called side clearance between opposing inside surfaces of the pump housing and both axial direction end surfaces, which are in sliding-contact with the respective opposing inside surfaces of the pump housing, of the cam ring.

However, since the second control hydraulic chamber is located at a discharge side area that is a high pressure area of each pump chamber, for instance, in a case where a viscosity of oil is low, e.g. when temperature of the oil (the working fluid) is high, a sealing performance by the side clearance is inadequate, and there is a risk that a high pressure oil in each pump chamber will leak into the second control hydraulic chamber through the side clearance. That is, rapid or smooth discharge of the oil from the second control hydraulic chamber becomes impossible due to passage resistances of the electromagnetic switching valve and the pilot valve at times when performing a low pressure control and a high pressure control, then a leak amount of the oil flowing into the second control hydraulic chamber through the side clearance becomes relatively large.

Because of this, an internal pressure of the second control hydraulic chamber becomes high, and this moves the cam ring to the eccentric direction, then there is a risk that a control pressure of the pump will increase against the intention of the control.

Therefore, it is conceivable that by thickening a radial direction width (a radial direction thickness) of the camring as a whole, a seal width of the side clearance is widened, and the sealing performance is increased. However, if the radial direction width (the radial direction thickness) of the camring as a whole is thickened, a weight of the whole of the pump is increased.

The present invention was made in view of the above technical problem of the related-art variable displacement pump. An object of the present invention is therefore to provide a variable displacement pump that is capable of suppressing the increase in weight of the whole of the pump while suppressing the increase in the pump control pressure against the intention of the control.

Solution to Problem

A variable displacement pump of the present invention comprises: a rotor that is driven and rotates; a plurality of vanes that are provided at an outer circumferential portion of the rotor so as to be able to extend and retract; a ring-shaped movable member that defines a plurality of working fluid chambers by accommodating the rotor and the plurality of vanes at an inner circumferential side of the movable member and changes a volume variation of each working fluid chamber during rotation of the rotor by moving so that an inner circumferential center of the movable member changes with respect to a rotation center of the rotor; a pump housing that houses therein the rotor, the vanes and the movable member, both axial direction end surfaces of the movable member being in sliding-contact with both opposing inside surfaces of the pump housing; an inlet section that is formed on at least one of the both inside surfaces of the pump housing and opens in an inlet-side area where a volume of each working fluid chamber is increased by the rotation of the rotor; an outlet section that is formed on at least one of the both inside surfaces of the pump housing and opens in an outlet-side area where the volume of each working fluid chamber is decreased by the rotation of the rotor; a first control hydraulic chamber that, by an internal pressure thereof generated by being supplied with a discharge pressure discharged from the outlet section, gives a force to the movable member in a direction in which the volume variation of each working fluid chamber is decreased; a second control hydraulic chamber that, by supply and discharge of the discharge pressure and interruption of the supply of the discharge pressure which are selectively switched by a switching mechanism, gives a force to the movable member in a direction in which the volume variation of each working fluid chamber is changed; a first seal part that is formed on the both end surfaces of the movable member, which are in sliding-contact with the both inside surfaces of the pump housing, and seals a gap between each working fluid chamber and the first control hydraulic chamber; and a second seal part which is formed on the both end surfaces of the movable member and seals a gap between each working fluid chamber and the second control hydraulic chamber in the outlet-side area, and whose radial direction width is greater than a radial direction width of the first seal part.

Effects of Invention

According to the present invention, it is possible to suppress the increase in weight of the whole of the pump while suppressing the increase in the pump control pressure against the intention of the control.

EMBODIMENTS FOR CARRYING OUT THE INVENTION

Embodiments of a variable displacement pump of the present invention will be explained below with reference to the drawings. The followings are embodiments showing that the variable displacement pump is applied as an oil pump that supplies lubricating oil to sliding parts in an internal combustion engine of a vehicle or a valve timing control device (VTC) that performs an opening/closing timing control of an engine valve.

First Embodiment

Figure 1:
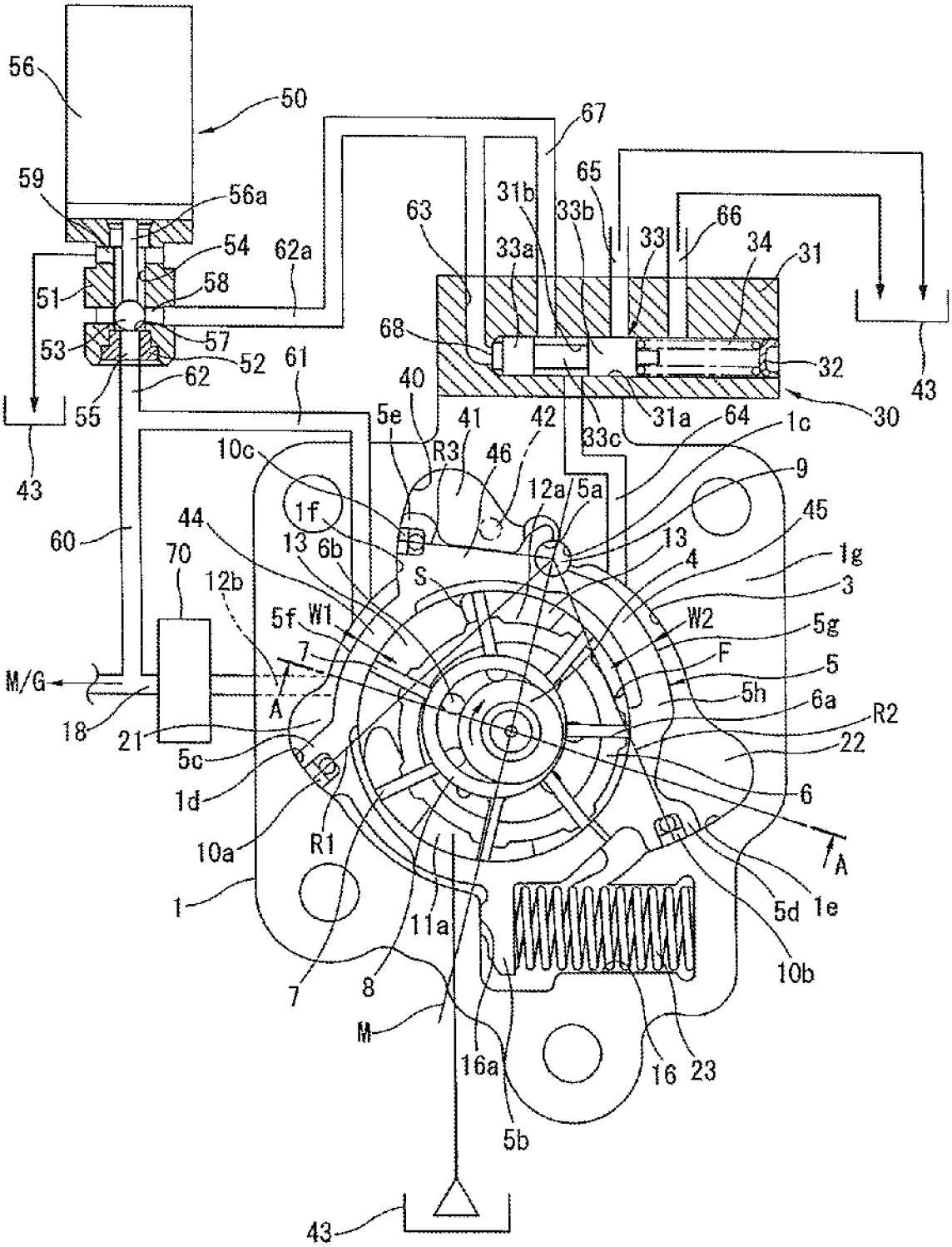
FIG. 1 is a front view of a variable displacement pump according to a first embodiment of the present invention with a cover member removed.
Figure 2:
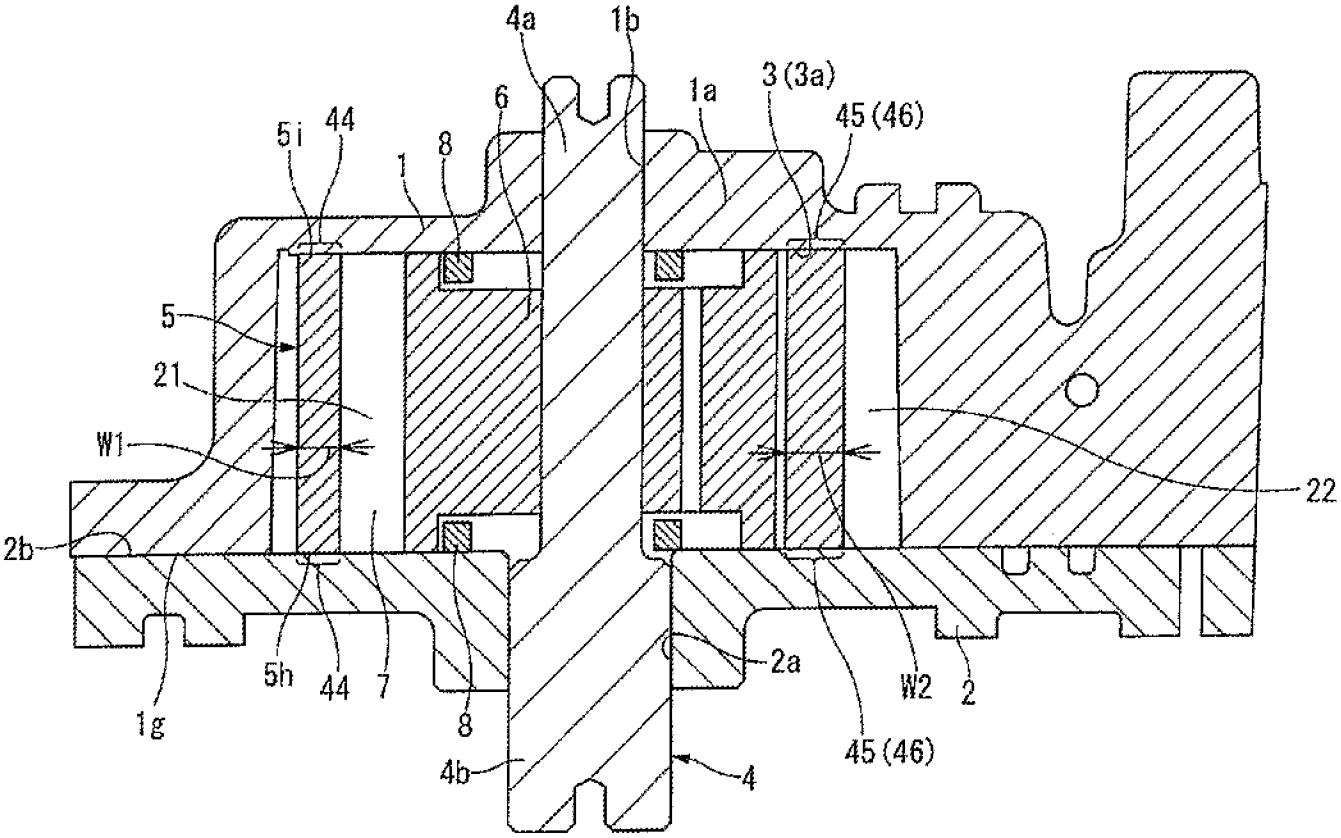
FIG. 2 is a sectional view taken along an A-A line of FIG. 1.

The variable displacement pump is provided at a front end portion of a cylinder block (not shown) of an internal combustion engine (not shown). As shown in FIGS. 1 and 2, the variable displacement pump has a pump housing formed by a pump body 1 which has a square bracket in a longitudinal cross section, whose one end side is open and which has therein a pump accommodation chamber 3 and a cover member 2 which covers the one end opening of the pump body 1, a drive shaft 4 that is rotatably supported by the pump housing with the drive shaft 4 penetrating a substantially middle of the pump accommodation chamber 3 and that is driven and rotates by a crankshaft (not shown) of the engine (not shown), a cam ring 5 that is movably (rockably) accommodated in the pump accommodation chamber 3 and changes a volume variation of each pump chamber 13 in cooperation with after-mentioned first and second control hydraulic chambers 21 and 22 and coil spring 23, and a pump configuration unit that is accommodated at an inner circumferential side of the cam ring 5, increases and decreases a volume of each of the plurality of pump chambers 13 as working fluid chambers formed between the pump configuration unit and the cam ring 5 by being driven and rotated in a clockwise direction in FIG. 1 by the drive shaft 4 then performs a pumping work.

A pump cover (the cover member 2) is provided with a pilot valve 30 that is a control mechanism that performs a supply/discharge control of a hydraulic pressure to and from the second control hydraulic chamber 22 and an interrupting control of the oil supply. Further, a solenoid valve 50 as a switching mechanism that performs a switching control of introduction of oil that is a discharged working fluid to the pilot valve 30 side is provided on an after-mentioned control pressure introduction passage 60 formed between the pilot valve 30 and an after-mentioned discharge passage 18.

The pump configuration unit is formed by a rotor 6 which is rotatably accommodated at the inner circumferential side of the cam ring 5 and whose middle portion is secured to an outer circumference of the drive shaft 4, a plurality of vanes 7 that are accommodated so as to be able to extend/retract in a plurality of slits 6*a* formed at an outer circumferential portion of the rotor 6 by being cut in a radial direction, and a pair of ring members 8, 8 that have a smaller diameter than that of the rotor 6 and are provided at inner circumferential side both side portions of the rotor 6.

Figure 3:
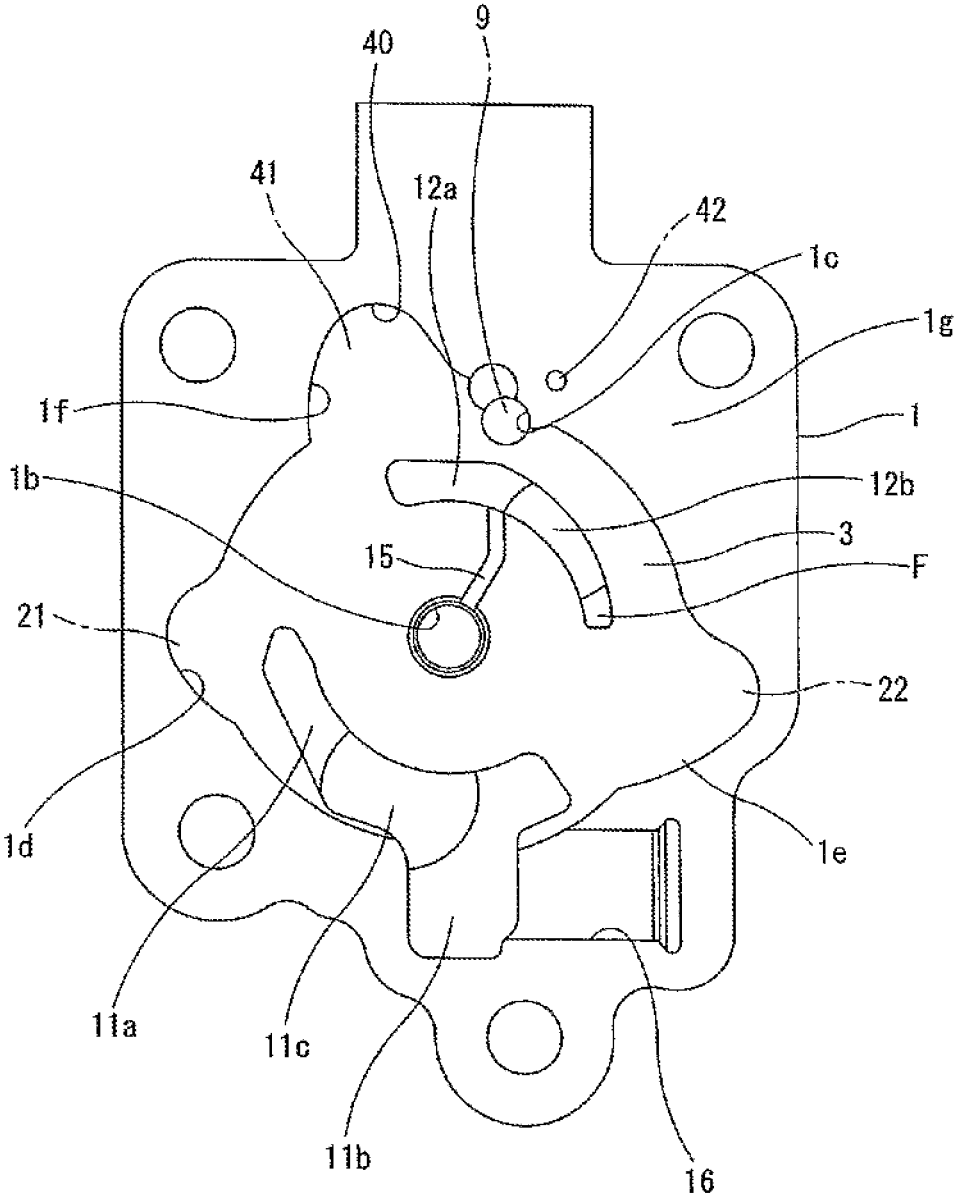
FIG. 3 is a drawing showing a pump body of the present embodiment, viewed from a mating surface side with the cover member.

The pump body 1 is formed as a single-piece body with aluminum alloy. As shown in FIG. 1 to 3, the pump body 1 is shaped into a rectangle that extends in up-and-down directions, and a width of the pump body 1 is smaller than a length in the up-and-down directions of the pump body 1. The pump body 1 is provided, at a substantially middle position on an end wall 1*a* forming a bottom surface of the pump accommodation chamber 3, with a bearing hole 1*b* that rotatably supports one end portion 4*a* of the drive shaft 4. Further, a supporting groove 1*c* having a substantially semicircular shape in cross section, which rockably supports the cam ring 5 through a rod-shaped pivot pin 9 as a rocking fulcrum, is formed by being cut at a predetermined position on an inner circumferential wall of the pump accommodation chamber 3.

Furthermore, on an inner circumferential surface of the pump accommodation chamber 3, at a left half side in FIG. 1 with respect to a line (hereinafter, called a cam ring reference line) M passing through a center of the bearing hole 1*b* and a center of the supporting groove 1*c* (the pivot pin 9), a first seal sliding contact surface 1*d* with which a first seal member 10*a* provided at an outer circumferential portion of the cam ring 5 is in sliding-contact is formed. This first seal sliding contact surface 1*d* is formed into an arc surface shape formed with a predetermined radius R1 being separated from a center of the supporting groove 1*c*. Further, a circumferential direction length of the first seal sliding contact surface 1*d* is set such that the first seal member 10*a* can always be in sliding-contact with the first seal sliding contact surface 1*d* within an eccentric rocking range of the cam ring 5. Likewise, also at a right half side in FIG. 1 with respect to the cam ring reference line M, a second seal sliding contact surface 1*e* with which a second seal member 10*b* provided at the outer circumferential portion of the cam ring 5 is in sliding-contact is formed. This second seal sliding contact surface 1*e* is formed into an arc surface shape formed with a predetermined radius R2 being separated from the center of the supporting groove 1*c*. Further, a circumferential direction length of the second seal sliding contact surface 1*e* is set such that the second seal member 10*b* can always be in sliding-contact with the second seal sliding contact surface 1*e* within the eccentric rocking range of the cam ring 5.

An arc hollow groove 40 that forms an after-mentioned low pressure chamber 41 is formed between the supporting groove 1*c* on the inner circumferential surface of the pump accommodation chamber 3 and the first control hydraulic chamber 21 defined by the first seal sliding contact surface 1*d*. On an inside surface at the first control hydraulic chamber 21 side of the hollow groove 40, a third seal sliding contact surface 1*f* with which a third seal member 10*c* provided at the outer circumferential portion of the cam ring 5 is in sliding-contact is formed. This third seal sliding contact surface 1*f* is formed into an arc surface shape formed with a predetermined radius R3 being separated from the center of the supporting groove 1*c*. Further, a circumferential direction length of the third seal sliding contact surface 1*f* is set such that the third seal member 10*c* can always be in sliding-contact with the third seal sliding contact surface 1*f* within the eccentric rocking range of the cam ring 5.

Here, the circumferential direction lengths of R1, R2 and R3 satisfy a relationship of R1>R2>R3

The hollow groove 40 is formed, as shown in FIGS. 1 and 3, at a left side of the pivot pin 9 in the drawings. The hollow groove 40 as a whole is shaped into an arc shape that extends in an up-and-down longitudinal direction on an inner circumferential surface of the pump body 1.

On an inside surface of the end wall 1*a* of the pump body 1, as specifically shown in FIG. 1, a substantially arc-shaped recessed inlet port 11*a* as an inlet section that is open in an area (hereinafter, called an inlet-side area) where the volume of each pump chamber 13 is increased by and according to a pumping operation of the pump configuration unit is formed at an outer circumferential area of the bearing hole 1*b*. Further, a substantially arc-shaped recessed outlet port 12*a* as an outlet section that is open in an area (hereinafter, called an outlet-side area) where the volume of each pump chamber 13 is decreased by and according to the pumping operation of the pump configuration unit is formed at the outer circumferential area of the bearing hole 1*b*. These inlet port 11*a* and outlet port 12*a* are formed by being cut, and arranged at substantially opposite sides of the bearing hole 1*b* at upper and lower sides of the bearing hole 1*b*.

As the outlet-side area of the present embodiment, as shown in FIG. 1, it is formed from a start end S up to a termination end F of the outlet port 12*a* in a rotation direction of the drive shaft 4 (the rotor 6).

The inlet port 11*a* has, at a substantially middle position in a circumferential direction thereof, an introduction portion 11*b* that is formed as an integral part of the inlet port 11*a* so as to extend to an after-mentioned spring accommodation chamber 16 side. Further, the inlet port 11*a* has, at a position close to a boundary between this introduction portion 11*b* and the inlet port 11*a*, an inlet hole 11*c* that penetrates the end wall 1*a* of the pump body 1 and opens to an external portion. Therefore, oil stored in an oil pan 43 is sucked into each pump chamber 13 in the inlet-side area by a negative pressure generated according to the pumping operation by the pump configuration unit through the inlet hole 11*c* and the inlet port 11*a*.

The outlet port 12*a* has, at a termination end F side thereof, an outlet hole 12*b* that penetrates the end wall 1*a* of the pump body 1 and opens to the external portion. Therefore, as shown in FIG. 1, oil pressurized by the pumping operation and discharged to the outlet port 12*a* is supplied to the sliding parts in the internal combustion engine and the VTC etc. from the outlet hole 12*b* through the discharge passage 18 formed inside the cylinder block (not shown) and a main oil gallery (not shown). At a downstream side of the discharge passage 18, an oil cooler and an oil filter 70 are provided.

Further, a communication groove 15 that connects the outlet port 12*a* and the bearing hole 1*b* is formed at the outlet port 12*a* by being cut. The oil is supplied to the bearing hole 1*b* from this communication groove 15, and also the oil is supplied to the rotor 6 and a side portion of each vane 7, thereby securing good lubrication of each sliding part.

Figure 4:
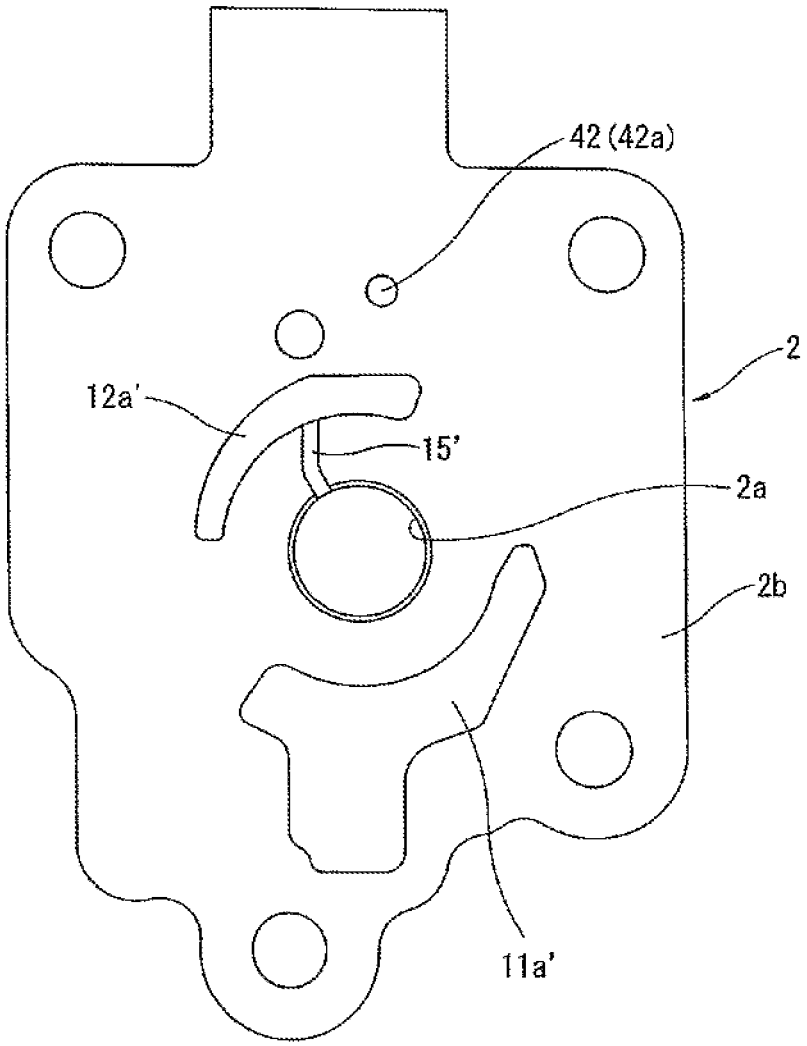
FIG. 4 is a drawing showing the cover member of the present embodiment, viewed from a mating surface side with the pump body.

The cover member 2 has a plate shape, as shown in FIGS. 2 and 4. The cover member 2 is shaped into a rectangle that extends in the up-and-down directions so as to be fitted to an outside shape of the pump body 1. An outer circumferential side of an inside surface 2*b* of the cover member 2 is fixed to a fixing surface 1*g*, on an opening side of the pump accommodation chamber 3, of the pump body 1 with a plurality of bolts (not shown). The cover member 2 is provided, at a position corresponding to the bearing hole 1*b* of the pump body 1, with a bearing hole 2*a* that rotatably supports a large diameter other end portion 4*b* of the drive shaft 4.

In the same manner as the pump body 1, also on the inside surface 2*b* of the cover member 2, an inlet port 11*a*', an outlet port 12*a*' and a communication groove 15' are formed at the respective opposing sides to the inlet port 11*a*, the outlet port 12*a* and the communication groove 15 of the pump body 1. Here, the inlet port and the outlet port could be formed at either one of the pump body 1 side or the cover member 2 side.

As shown in FIG. 2, the small diameter one end portion 4*a* of the drive shaft 4 is supported by the bearing hole 1*b* formed at the end wall 1*a* of the pump body 1. On the other hand, the large diameter other end portion 4*b* of the drive shaft 4 is supported by the bearing hole 2*a* of the cover member 2, and a top end side of the large diameter other end portion 4*b* protrudes to the outside and is linked to the crankshaft etc. The drive shaft 4 rotates the rotor 6 in the clockwise direction (in an arrow direction) in FIG. 1 by a rotation force transmitted from the crankshaft.

As shown in FIG. 1, the rotor 6 has a plurality of slits 6*a* formed in a radial direction from a center side to a radial direction outer side. Further, a back pressure chamber 6*b* which has a substantially circular shape in cross section and into which the discharged oil as the working fluid is introduced is formed at an inner side base end portion of each slit 6*a*. Therefore, each vane 7 is pushed out outwards by centrifugal force generated by rotation of the rotor 6 and a hydraulic pressure of the back pressure chamber 6*b*.

A top end surface of each vane 7 is in sliding-contact with an inner circumferential surface of the cam ring 5 during rotation of the rotor 6, and a base end surface of each vane 7 is in sliding-contact with an outer circumferential surface of each of the ring members 8, 8 during rotation of the rotor 6.

As shown in FIGS. 1 and 2, the cam ring 5 is formed, as a single-piece component, into a substantially cylindrical shape with so-called sintered alloy. The cam ring 5 has, at a predetermined position of an outer circumferential portion thereof, a substantially arc-shaped recessed grooved pivot portion 5*a* that is formed along an axial direction of the cam ring 5 and fitted onto the pivot pin 9. In addition, the cam ring 5 has, at a position opposite to this pivot portion 5*a*, an arm portion 5*b* that protrudes in the radial direction and contacts or is connected to the after-mentioned coil spring 23 as a forcing member which is set to a predetermined spring constant.

As shown in FIGS. 1 and 3, at a lower end position inside the pump body 1, a spring accommodation chamber 16 is formed at a position opposite to the supporting groove 1*c*. The coil spring 23 that is given a predetermined set load K is elastically installed between one end wall of the spring accommodation chamber 16 and one side surface of the arm portion 5*b* in the spring accommodation chamber 16. The other end wall of the spring accommodation chamber 16 serves as a restraining surface 16*a* that restrains the moving range (or the rocking range) in an eccentric direction of the cam ring 5. That is, by contact of the other side surface of the arm portion 5*b* with this restraining surface 16*a*, the movement (the rock) in the eccentric direction of the cam ring 5 is restrained to their contact position.

In this manner, the cam ring 5 is always forced in a direction (in the clockwise direction in FIG. 1) in which an eccentric amount of the cam ring 5 is increased by an urging force of the coil spring 23 through the arm portion 5*b*. That is, in a non-operation state, as shown in FIG. 1, the other side surface of the arm portion 5*b* is pressed against the restraining surface 16*a*, and the cam ring 5 is limited to a position at which the eccentric amount of the cam ring 5 is a maximum.

Further, arc-shaped first, second and third seal configuration portions 5*c*, 5*d* and 5*e*, which are concentric with the respective first, second and third seal sliding contact surfaces 1*d*, 1*e* and 1*f* formed by an inner circumferential wall of the pump body 1, are formed at positions facing to the respective first, second and third seal sliding contact surfaces 1*d*, 1*e* and 1*f* so as to protrude from the outer circumferential portion of the cam ring 5. The first, second and third seal members 10*a*, 10*b* and 10*c*, which are in sliding-contact with the first, second and third seal sliding contact surfaces 1*d*, 1*e* and 1*f* respectively upon eccentric rocking of the cam ring 5, are accommodated and held in seal holding grooves formed at seal surfaces of the seal configuration portions 5*c*, 5*d* and 5*e* respectively.

Each of the first, second and third seal members 10*a*, 10*b* and 10*c* is made of fluorine resin material having a low friction property, and has a long narrow straight shape along the axial direction of the cam ring 5. The first, second and third seal members 10*a*, 10*b* and 10*c* are pressed against the first, second and third seal sliding contact surfaces 1*d*, 1*e* and 1*f* respectively by elastic forces of elastic members that are made of rubber and provided at bottoms of the respective seal holding grooves, thereby liquid-tightly sealing gaps between the seal sliding contact surfaces 1*d*, 1*e* and 1*f* and the seal surfaces of the seal configuration portions 5*c*, 5*d* and 5*e*.

Between the outer circumferential surface of the cam ring 5 and the inner circumferential surface of the pump body 1, as shown in FIG. 1, the first control hydraulic chamber 21, the second control hydraulic chamber 22 and the low pressure chamber 41 are formed at right and left positions in a circumferential direction with the pivot pin 9 being a center.

More specifically, the first control hydraulic chamber 21 is defined between the first seal member 10*a* and the third seal member 10*c*. The second control hydraulic chamber 22 is defined between the pivot pin 9 and the second seal member 10*b*. The low pressure chamber 41 is defined between the pivot pin 9 and the third seal member 10*c*.

Therefore, a first pressure receiving surface 5*f*, which faces to the first control hydraulic chamber 21, of the outer circumferential surface of the cam ring 5 is formed to be smaller due to the presence of the low pressure chamber 41 defined between the pivot pin 9 and the third seal member 10*c*, while a second pressure receiving surface 5*g* which greatly extends from the pivot pin 9 in the circumferential direction and faces to the second control hydraulic chamber 22 is formed to be larger. With this structure, when the same hydraulic pressure (the same discharge pressure) acts on both of the first and second control hydraulic chambers 21 and 22, on the whole, the cam ring 5 is forced in the direction (in the clockwise direction in FIG. 1) in which the eccentric amount of the cam ring 5 is increased.

The first and second control hydraulic chambers 21 and 22 are configured so that the pump discharge pressure is introduced into the first and second control hydraulic chambers 21 and 22 through the control pressure introduction passage 60 that branches off from the discharge passage 18. That is, the first control hydraulic chamber 21 is supplied with the pump discharge pressure through a first introduction passage 61 that is one side of a bifurcated passage further branching off from the control pressure introduction passage 60. On the other hand, the second control hydraulic chamber 22 is supplied with the pump discharge pressure from a second introduction passage 62 that is the other side of the bifurcated passage through the electromagnetic switching valve 50 and the pilot valve 30. These hydraulic pressures act on the first and second pressure receiving surface 5*f* and 5*g* of the cam ring 5 which face to the first and second control hydraulic chambers 21 and 22 respectively, then a moving force (a rocking force) is given to the cam ring 5.

Therefore, in the oil pump, when an urging force based on internal pressures of the first and second control hydraulic chambers 21 and 22 is smaller than the set load K of the coil spring 23, the cam ring 5 is in a maximum eccentric state shown in FIG. 1. On the other hand, when the urging force based on the internal pressures of the first and second control hydraulic chambers 21 and 22 exceeds the set load K of the coil spring 23 by and according to increase in the pump discharge pressure, the cam ring 5 moves or rocks in a concentric direction in accordance with the pump discharge pressure.

The low pressure chamber 41 is formed along the up-and-down directions of the pump body 1 by the hollow groove 40, as shown in FIGS. 1 to 3. The low pressure chamber 41 opens to the atmospheric air outside the pump and also communicates with the oil pan 43 through a communication hole 42 formed at the cover member 2 so as to penetrate the cover member 2. That is, as described later, oil leaking out from sliding contact surfaces (side clearances) between both axial direction end surfaces 5*h* and 5*i* of the cam ring 5, the pump body 1 and the cover member 2 and so-called contaminant getting into the oil flow into the low pressure chamber 41 by the pumping operation. The low pressure chamber 41 is configured to discharge these oil and contaminant to the oil pan 43 through the communication hole 42.

The communication hole 42 is located at a position close to the pivot pin 9 on a gravitational direction lower side in the low pressure chamber 41. The communication hole 42 is formed substantially horizontally by a long narrow hole having a small diameter which penetrates a wall portion of the cover member 2. One end portion 42*a* of the communication hole 42 opens at a bottom side of the low pressure chamber 41. The other end portion 42*b* of the communication hole 42 opens at an outside surface of the cover member 2, and extends or is connected to the oil pan 43.

The one end portion 42*a* of the communication hole 42 is provided at a position that always secures communication between the low pressure chamber 41 and the oil pan 43 by the communication hole 42 at any rocking position of the cam ring 5 without being closed by the cam ring 5.

As shown in FIG. 2, gaps or boundaries between the first and second control hydraulic chambers 21 and 22 and each pump chamber 13 are sealed by so-called side clearances formed between a bottom surface 3*a*, which is in sliding-contact with the axial direction end surface 5*i* of the cam ring 5, of an inside surface of the pump accommodation chamber 3 at the pump body 1 side and this axial direction end surface 5*i* of the cam ring 5 and between the inside surface 2*b*, which is in sliding-contact with the axial direction end surface 5*h* of the cam ring 5, of the cover member 2 and this axial direction end surface 5*h* of the cam ring 5.

Gaps or boundaries between the low pressure chamber 41 and each pump chamber 13 are also sealed by the side clearances between the both axial direction end surfaces 5*h* and 5*i* of the cam ring 5, the bottom surface 3*a* of the pump accommodation chamber 3 and the inside surface 2*b* of the cover member 2.

As shown in FIGS. 1 and 2, a section, which seals the gaps or the boundaries between the first control hydraulic chamber 21 and each pump chamber 13, of the both axial direction end surfaces 5*h* and 5*i* of the cam ring 5 which form the side clearances is called a first seal surface 44 as a first seal part. A section, which seals the gaps or the boundaries between the second control hydraulic chamber 22 and each pump chamber 13, of the both axial direction end surfaces 5*h* and 5*i* of the cam ring 5 is called a second seal surface 45 as a second seal part. Further, a section, which seals the gaps or the boundaries between the low pressure chamber 41 located at the outlet-side area and each pump chamber 13, of the both axial direction end surfaces 5*h* and 5*i* of the cam ring 5 is called a third seal surface 46 as a third seal part. Although the first to third seal parts 44 to 46 are formed on the both axial direction end surfaces 5*h* and 5*i* of the cam ring 5, in the flowing description, for the sake of convenience, only one end surface 5*h* side, which is shown in FIG. 1, will be explained.

The second and third second seal surfaces 45 and 46 are formed so that a width W2 in the radial direction of the second seal surface 45 and a width W2 in the radial direction of the third seal surface 46 are substantially the same as each other. Further, this radial direction width W2 is greater than a radial direction width W1 of the first seal surface 44.

That is, the pump chambers 13 at the first control hydraulic chamber 21 side are located in the inlet-side area with which the inlet ports 11*a* and 11*a*' communicate, and the pump chambers 13 in this inlet-side area are in a negative pressure (low pressure) state. Because of this, a hydraulic pressure acting on the first seal surface 44 is a low pressure. On the other hand, the pump chambers 13 at the second control hydraulic chamber 22 side and the low pressure chamber 41 side are located in the outlet-side area (from the start ends up to the termination end F of the outlet ports 12*a* and 12*a*') with which the outlet ports 12*a* and 12*a*' communicate, and the pump chambers 13 in this outlet-side area are in a positive pressure (high pressure) state. Because of this, a hydraulic pressure acting on the second seal surface 45 and the third seal surface 46 is a high pressure.

Hence, in the present embodiment, by setting the radial direction width W2 of the second and third second seal surfaces 45 and 46 to be greater than the radial direction width W1 of the first seal surface 44, each of seal areas of the second and third second seal surfaces 45 and 46, which are formed by a relative connection with the bottom surface 3*a* of the pump accommodation chamber 3, is larger than a seal area of the first seal surface 44.

More specifically, for instance, as specifications of the oil pump of the present embodiment, an average radial direction width W1 of the first seal surface 44 is set to about 3.5 mm, whereas an average radial direction width W2 of the second and third second seal surfaces 45 and 46 is set to about 5.0 mm that is greater than the average radial direction width W1.

As shown in FIG. 1, the pilot valve 30 is provided at an upper end portion located in a longitudinal direction of the cover member 2 of the pump body 1 as an overlap portion with the cover member 2, and is arranged along a transverse direction.

The pilot valve 30 is formed mainly by a cylindrical valve body 31 that extends to an outer side of the cover member 2, a plug 32 that closes a bottom opening of the valve body 31, a spool valve body 33 that is slidably accommodated in a valve accommodation hole 31*a* formed in the valve body 31 along an axial direction of the valve body 31 and controls supply and discharge of the hydraulic pressure to and from the second control hydraulic chamber 22 by a pair of first and second land portions 33*a* and 33*b* that are in sliding-contact with an inner circumferential surface of the valve body 31, and a valve spring 34 that is elastically installed between the plug 32 and the spool valve body 33 at other end side inner circumferential side of the valve body 31 with a predetermined set load given to the valve spring 34 and always forces the spool valve body 33 to one end side of the valve body 31.

An introduction port 63 that is connected to the solenoid valve 50 through a passage (hereinafter, called a downstream side passage) 62*a* located at a downstream side of the second introduction passage 62 opens at one end portion of the valve body 31. Further, inside the valve body 31 and the pump body 1, a passage is formed at an axial direction middle position between the valve body 31 and the pump body 1, and its one end side is connected to the second control hydraulic chamber 22, and its other end side is always connected to an after-mentioned intermediate chamber 31*b*. With this, a supply/discharge port 64 that supplies and discharges the hydraulic pressure to and from the second control hydraulic chamber 22 is formed.

Furthermore, a first drain port 65, one end side of which directly opens to the outside or is connected to the inlet side, and the other end side of which discharges the hydraulic pressure from the second control hydraulic chamber 22 through the intermediate chamber 31*b* by switching a connection with this intermediate chamber 31*b*, is formed at a substantially middle position in an axial direction of a peripheral wall of the valve body 31. Also at the axial direction position of the valve body 31 which is an overlap portion with an after-mentioned back pressure chamber, in the same manner as the first drain port 65, a second drain port 66 that directly opens to the outside or is connected to the inlet side is formed.

Moreover, a communication oil passage 67 that communicates with the valve body 31 in a state in which the spool valve body 33 is positioned at a left end side position in FIG. 1 in cooperation with the pump body 1 is formed at the peripheral wall of the valve body 31.

The spool valve body 33 has a small diameter shaft portion 33*c* formed between the first and second land portions 33*a* and 33*b* that are both end portions in the axial direction. The spool valve body 33 is provided with a pressure chamber 68 which is formed at an axial direction outer end side of the first land portion 33*a* in the valve body 31 and into which the discharge pressure from the introduction port 63 is introduced, the intermediate chamber 31*b* that is formed at an outer periphery of the small diameter shaft portion 33*c* and connects the supply/discharge port 64 and the communication oil passage 67 or connects the supply/discharge port 64 and the first drain port 65 according to an axial direction position of the spool valve body 33, and the back pressure chamber that is formed between the second land portion 33*b* and the plug 32 and serves to discharge oil leaking out from the intermediate chamber 31*b* through an outer peripheral side (a slight gap) of the second land portion 33*b*.

By such a configuration of the pilot valve 30, in the pilot valve 30, in a state in which the discharge pressure introduced into the pressure chamber 68 from the introduction port 63 is a predetermined pressure (an after-mentioned spool operating pressure Ps) or less, the spool valve body 33 is positioned at the one end side of the valve accommodation hole 31*a* by an urging force of the valve spring 34 (see FIG. 1). That is, by the fact that the spool valve body 33 is positioned at the one end side of the valve accommodation hole 31*a*, the communication oil passage 67 communicates with the intermediate chamber 31*b* and the intermediate chamber 31*b* communicates with the second control hydraulic chamber 22 through the supply/discharge port 64, whereas communication between the first drain port 65 and the intermediate chamber 31*b* is interrupted by the second land portion 33*b*. As a consequence, the hydraulic pressure introduced from the downstream side passage 62*a* through the communication oil passage 67 is supplied to the second control hydraulic chamber 22 through the intermediate chamber 31*b* and the supply/discharge port 64.

When the discharge pressure introduced into the pressure chamber 68 exceeds the predetermined pressure, the spool valve body 33 moves from the one end side to the other end side of the valve accommodation hole 31*a* against the urging force of the valve spring 34, then communication between the second control hydraulic chamber 22 and the intermediate chamber 31*b* through the supply/discharge port 64 is maintained. On the other hand, when communication between the communication oil passage 67 and the intermediate chamber 31*b* is interrupted by the first land portion 33*a*, at the same time as this interruption, the intermediate chamber 31*b* and the oil pan 43 communicate with each other through the first drain port 65. As a consequence, the communication is changed such that the oil in the second control hydraulic chamber 22 is discharged to the oil pan 43 from the first drain port 65 through the supply/discharge port 64 and the intermediate chamber 31*b*.

Here, "at the same time as this interruption" means that at a change timing, both of the communication oil passage 67 and the first drain port 65 communicate with the supply/discharge port 64 for a short time, or communications of the both with the supply/discharge port 64 are interrupted for a short time.

As shown in FIG. 1, the solenoid valve 50 is accommodated in a valve accommodation hole (not shown) that is formed at some midpoint of the control pressure introduction passage 60. The solenoid valve 50 is formed mainly by a cylindrical valve body 51 having therein an oil passage 54 formed along an axial direction of the cylindrical valve body 51, a seat member 52 fixed to a top end side inner portion of the oil passage 54 and having an introduction port 55 that is connected to an upstream side of the second introduction passage 62, a ball valve body 53 provided so as to be able to be seated on and separate from a valve seat that is formed at an inner end opening edge of the seat member 52 and serving to open and close the introduction port 55, and a solenoid 56 provided at other end portion of the valve body 51.

The valve body 51 also has, at an inner end opening edge of a valve body accommodation port 57 that accommodates therein the ball valve body 53, the same valve seat as the valve seat of the seat member 52. Further, the valve body 51 has, at an outer peripheral portion of the valve body accommodation port 57 on one end side of a peripheral wall thereof, a supply/discharge port 58 that is formed in a radial direction and is connected to the downstream side passage 62*a* for supplying and discharging the hydraulic pressure to and from the pilot valve 30. In addition, the valve body 51 has, at an outer peripheral portion of the oil passage 54 on the other end side of the peripheral wall thereof, a drain port 59 that is formed along the radial direction and communicates with the oil pan 43.

The solenoid 56 is configured so that when a coil accommodated in a casing is energized (the coil is fed with a current), an armature arranged at an inner circumferential side of the coil and a rod 56*a* fixed to this armature move forward in a lower side in FIG. 1 by an electromagnetic force generated by the energization.

The solenoid 56 is fed with an exciting current from a vehicle-mounted ECU (not shown) in accordance with an engine operating condition detected or calculated by an oil temperature and a water temperature of the internal combustion engine and a predetermined parameter such as an engine rotation speed.

That is, when the exciting current is fed to the solenoid 56, the rod 56*a* moves forward, and the ball valve body 53 positioned at a top end portion of this rod 56*a* is pressed against the valve seat of the seat member 52 side. With this, communication between the introduction port 55 and the supply/discharge port 58 is interrupted, and the supply/discharge port 58 and the drain port 59 communicate with each other through the oil passage 54.

On the other hand, when no exciting current is fed to the solenoid 56, the ball valve body 53 moves backward and is pressed against the valve seat of the valve body 51 side by and according to a discharge pressure introduced from the introduction port 55. With this, the introduction port 55 and the supply/discharge port 58 communicate with each other, and communication between the supply/discharge port 58 and the drain port 59 is interrupted.

[Operation of Oil Pump]

Operation of the oil pump of the present embodiment will be explained below.

Before explaining the operation of the oil pump, first, a necessary pressures for the internal combustion engine, which is a reference of a discharge pressure control of this oil pump, will be explained with reference to FIG. 6.

P1 in the drawing denotes an engine required pressure that corresponds to a required pressure for the VTC that is capable of improving fuel efficiency. P2 denotes an engine required pressure that corresponds to a required pressure for an oil jet for cooling a piston and an engine required pressure for lubrication of bearing parts of the crankshaft at a time when the engine rotation speed is high. A connecting line formed by connecting these points P1 and P2 by a solid line denotes an ideal necessary pressure (a discharge pressure) P according to the engine rotation speed.

Pc in the drawing denotes a cam ring operating pressure at which the cam ring 5 starts to move in the concentric direction against the urging force of the coil spring 23 having the set load K. Ps denotes a spool operating pressure at which the spool valve body 33 starts to move from the one end side to the other end side of the valve body 31 against the urging force of the valve spring 34 having a set load K1 and the first drain port 65 start to open.

Figure 6:
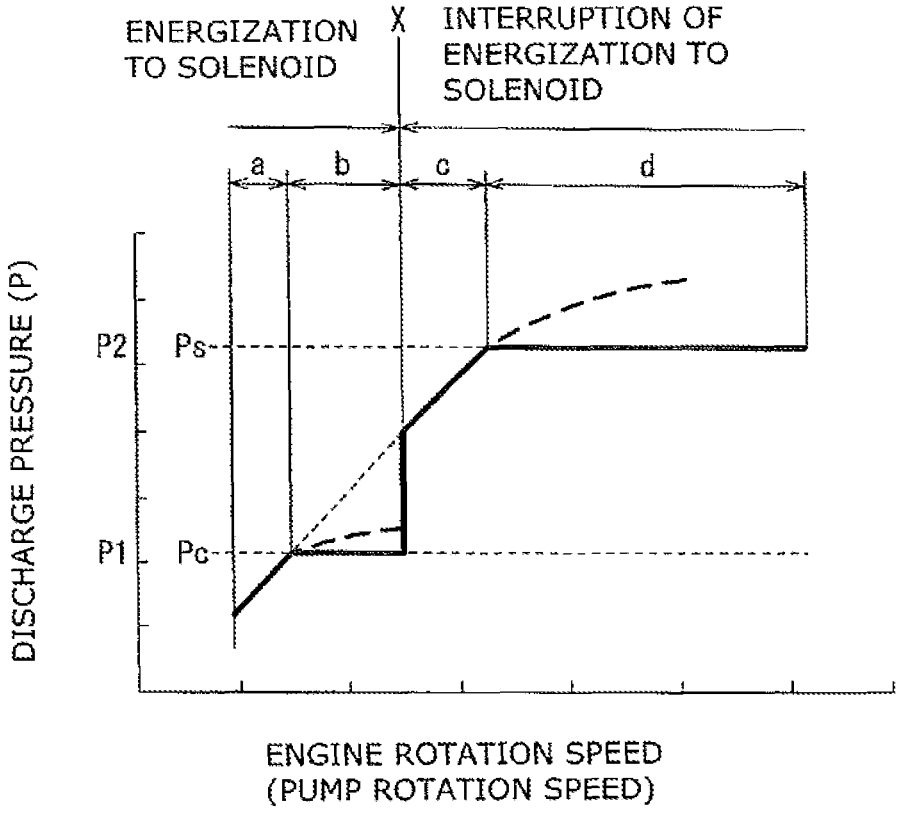
FIG. 6 is a graph showing a hydraulic pressure characteristic of the variable displacement pump of the present embodiment.

With these setting, in a section "a" in FIG. 6 which corresponds to a rotation range from an engine start to a low rotation range, the exciting current is fed to the solenoid 56 of the solenoid valve 50, and the communication between the introduction port 55 and the supply/discharge port 58 is interrupted, whereas the supply/discharge port 58 and the drain port 59 communicate with each other. With this, the discharge pressure P is not introduced into the second control hydraulic chamber 22 side (the pilot valve 30 side). Therefore, the spool valve body 33 of the pilot valve 30 is maintained at a leftmost position in FIG. 1. As a consequence, the oil in the second control hydraulic chamber 22 is discharged to the oil pan 43 from the drain port 59 of the solenoid valve 50 through the downstream side passage 62*a* and the oil passage 54, and the discharge pressure P is supplied only to the first control hydraulic chamber 21. This rotation range is in a state in which the discharge pressure (an engine inside pressure) P is lower than the cam ring operating pressure Pc. Because of this, the cam ring 5 is maintained at the maximum eccentric state. And, as characteristics of the discharge pressure P, the discharge pressure P increases substantially in proportion to the engine rotation speed.

Subsequently, when the engine rotation speed increases and the discharge pressure P reaches the cam ring operating pressure Pc (see FIG. 6), a current feeding state (an energizing state) of the solenoid 56 is maintained, and the supply of the discharge pressure P only to the first control hydraulic chamber 21 is continued. With this, the urging force based on the internal pressure of the first control hydraulic chamber 21 overcomes (exceeds) the urging force of the coil spring 23, and the cam ring 5 starts to move (rock) in the concentric direction. As a consequence, an increase amount of the discharge pressure P becomes small (in a section "b" in FIG. 6) as compared with the state in which the cam ring 5 is in the maximum eccentric state.

When the engine rotation speed further increases and the engine required pressure P2 is required in the engine operating state (see FIG. 6), the current feed (the energization) to the solenoid 56 is interrupted, and the introduction port 55 and the supply/discharge port 58 communicate with each other, whereas the communication between the supply/discharge port 58 and the drain port 59 is interrupted (at a time point X in FIG. 6). As a consequence, the discharge pressure P supplied to the second introduction passage 62 from the control pressure introduction passage 60 is introduced to the pilot valve 30 side through the downstream side passage 62*a*. At this time, when the discharge pressure P does not reach the spool operating pressure Ps yet, the spool valve body 33 of the pilot valve 30 is positioned at the one end side of the valve body 31 (a position shown in FIG. 1), and the communication oil passage 67 and the supply/discharge port 64 communicate with each other through the intermediate chamber 31*b*. The discharge pressure P is therefore supplied to the second control hydraulic chamber 22. With this, an urging force in the eccentric direction which is formed by a total force of the urging force of the coil spring 23 and the urging force based on the internal pressure of the second control hydraulic chamber 22 exceeds the urging force in the concentric direction which is based on the internal pressure of the first control hydraulic chamber 21. Because of this, the cam ring 5 is pressed back (or pushed back) to the eccentric direction, and the increase amount of the discharge pressure P becomes large (increases) again, then a high pressure characteristic appears (a section "c" in FIG. 6).

Afterwards, when the discharge pressure P increases according to this pressure increase characteristic and reaches the spool operating pressure Ps, the discharge pressure P is introduced into the pressure chamber 68 from the introduction port 63 by the pilot valve 30. The spool valve body 33 moves to the plug 32 side by this discharge pressure against the urging force of the valve spring 34, and the position of the spool valve body 33 is changed from the one end side to the other end side of the valve body 31.

Figure 5:
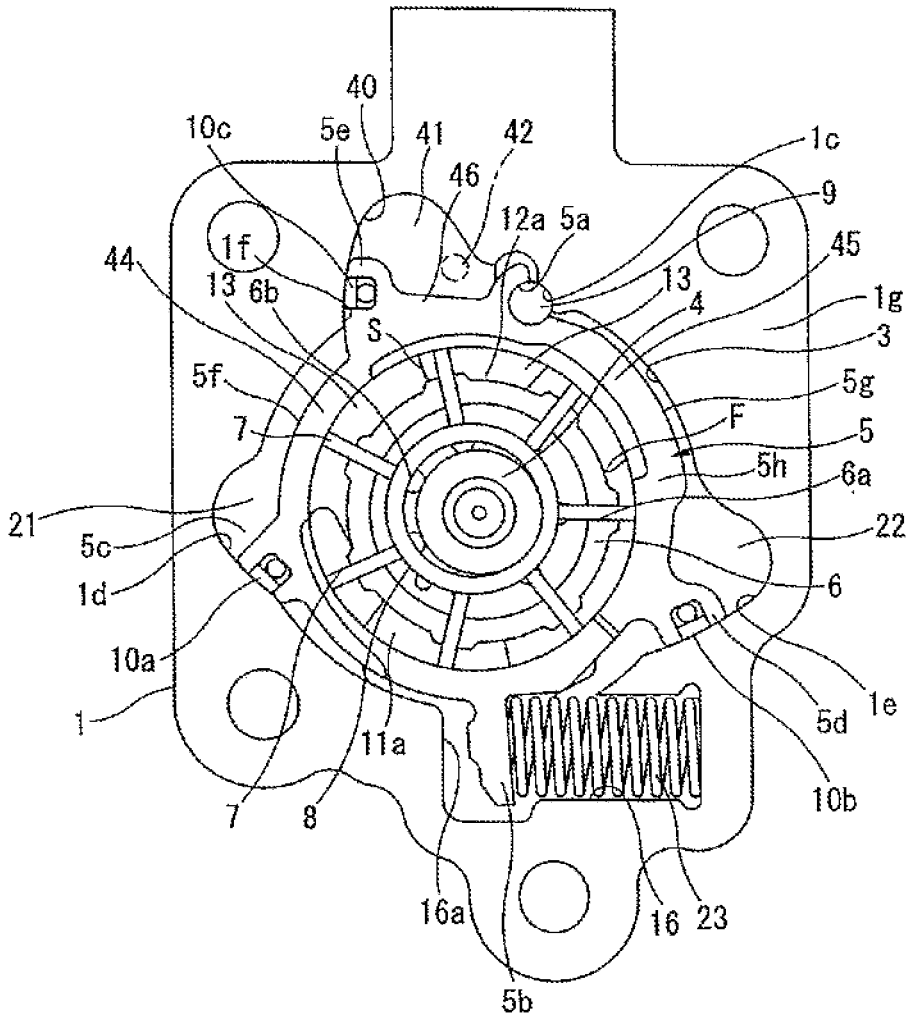
FIG. 5 is a drawing for explaining working of the variable displacement pump in a state in which an eccentric amount of a cam ring is decreased.

With this movement, an opening of the communication oil passage 67 at the valve accommodation hole 31*a* side is interrupted by the first land portion 33*a*. At the same time, the supply/discharge port 64 and the first drain port 65 communicate with each other through the intermediate chamber 31*b*, and the oil in the second control hydraulic chamber 22 is discharged, then the hydraulic pressure in the second control hydraulic chamber 22 is decreased and is lower than the discharge pressure P. As a consequence, the urging force in the concentric direction which is based on the internal pressure of the first control hydraulic chamber 21 exceeds the urging force in the eccentric direction which is formed by the total force of the urging force of the coil spring 23 and the urging force based on the internal pressure of the second control hydraulic chamber 22. The cam ring 5 then moves in the concentric direction as shown in FIG. 5, and the discharge pressure P is decreased.

Therefore, when a hydraulic pressure (the discharge pressure P) acting on one end of the spool valve body 33 falls below the spool operating pressure Ps due to this decrease of the discharge pressure P, the urging force of the valve spring 34 overcomes an urging force by this discharge pressure P, and the spool valve body 33 moves to the introduction port 63 side. With this movement, the communication oil passage 67 and the supply/discharge port 64 of the pilot valve 30 communicate with each other, and the discharge pressure is supplied to the second control hydraulic chamber 22 again. As a consequence, the cam ring 5 is pressed back (or pushed back) to the eccentric direction, and the discharge pressure P increases again, then a high pressure characteristic appears (a section "d" in FIG. 6).

After that, when the hydraulic pressure acting on the one end of the spool valve body 33 exceeds the spool operating pressure Ps due to this increase of the discharge pressure P, the spool valve body 33 moves to the other end side of the valve body 31 again against the urging force of the valve spring 34. With this movement, as described above, the oil in the second control hydraulic chamber 22 is decreased, and the discharge pressure P is supplied only to the first control hydraulic chamber 21. As a consequence, the urging force in the concentric direction which is based on the internal pressure of the first control hydraulic chamber 21 exceeds the urging force in the eccentric direction which is formed by the total force of the urging force of the coil spring 23 and the urging force based on the internal pressure of the second control hydraulic chamber 22. The cam ring 5 then moves in the concentric direction as shown in FIG. 5, and the discharge pressure P is decreased again.

In this manner, the oil pump is configured so that by the spool valve body 33 of the pilot valve 30, the communication between the supply/discharge port 64 communicating with the second control hydraulic chamber 22 and the communication oil passage 67 and the communication between the supply/discharge port 64 communicating with the second control hydraulic chamber 22 and the first drain port 65 are changed continuously and alternately, then the discharge pressure P is controlled to be maintained at the spool operating pressure Ps.

At this time, since this pressure control is performed by the change (or switch) of the supply/discharge port 64 in the pilot valve 30, the pressure control is unaffected by the spring constant of the coil spring 23. Further, since the pressure control is performed by an extremely short stroke range of the spool valve body 33 for the switch of the supply/discharge port 64, there is no risk that the pressure control will be affected by the spring constant of the valve spring 34. Consequently, in the section for this pressure control, as characteristics of the discharge pressure P of the oil pump, the discharge pressure P does not increase proportionally with increase in the engine rotation speed, but is almost flat. With this, it is possible to bring the discharge pressure P closer to the ideal necessary pressure as much as possible.

Therefore, in the engine rotation range (in the section "d" in FIG. 6) where maintaining the discharge pressure P at the predetermined high pressure (the spool operating pressure Ps) is required, the oil pump of the present embodiment can maintain the discharge pressure P at this high pressure by a pressure control by the pilot valve 30.

Further, in the present embodiment, the radial direction width W2 of the second and third second seal surfaces 45 and 46 of the cam ring 5 is set to be greater than the radial direction width W1 of the first seal surface 44. Therefore, for instance, even in a case where a viscosity of oil is low during the pumping operation, e.g. even when temperature of the oil (the working fluid) is high during the pumping operation, the second and third second seal surfaces 45 and 46 each have an adequate sealing performance. It is thus possible to properly suppress leak of high pressure oil in each pump chamber 13 in the outlet-side area to the second control hydraulic chamber 22 and the low pressure chamber 41.

That is, in a case, like the related-art variable displacement pump, where the radial direction width W2 of the second and third second seal surfaces 45 and 46 is relatively small in the same manner as the radial direction width W1 of the first seal surface 44, a sufficient seal area cannot be secured. For this reason, there is a risk that the high pressure oil in each pump chamber 13 in the outlet-side area will leak especially into the second control hydraulic chamber 22. On the other hand, at times when performing a low pressure control and a high pressure control, due to passage resistances of the electromagnetic switching valve 50 and the pilot valve 30, rapid or smooth discharge of the oil from the second control hydraulic chamber 22 becomes impossible. As a result, the internal pressure of the second control hydraulic chamber 22 becomes high, and this moves the cam ring 5 to the eccentric direction, then there is a risk that the control pressure of the pump will increase against the intention of the control (see a bold broken line in FIG. 6).

Therefore, in the present embodiment, as described above, by setting the radial direction width W2 of the second and third second seal surfaces 45 and 46 to be greater, large seal areas of these seal surfaces can be secured, then the leak of the oil from each pump chamber 13 into the second control hydraulic chamber 22 and the low pressure chamber 41 can be properly suppressed.

Accordingly, since the undesirable movement of the cam ring 5 to the eccentric direction is suppressed, as shown by the solid line in FIG. 6, it is possible to control the pump discharge pressure to the flat stable state also when performing the low pressure control and the high pressure control.

In addition, in the present embodiment, a radial direction width (a radial direction thickness) of the cam ring 5 as a whole is not thickened, but only the radial direction widths W2 of the second and third second seal surfaces 45 and 46 are partly thickened. Therefore, since the radial direction width W1 of the first seal surface 44 which is in the low pressure inlet-side area is relatively thin, an increase in weight of the cam ring 5 can be suppressed, and consequently this can suppress an increase in weight of the whole of the pump.

Furthermore, in the present embodiment, by providing the low pressure chamber 41 at the pump body 1, the first pressure receiving surface 5*f* of the cam ring 5, which is positioned at the first control hydraulic chamber 21, is relatively smaller, and a pressure receiving area of the second pressure receiving surface 5*g* positioned at the second control hydraulic chamber 22 is larger than a pressure receiving area of this first pressure receiving surface 5*f*. Because of this, it is possible to suppress an unstable behavior of the cam ring 5 which occurs due to air bubble getting into the oil caused by, for instance, aeration or cavitation in each pump chamber 13 in the high pressure state (P2 in FIG. 6) of the discharge pressure.

Moreover, the high pressure oil in each pump chamber 13 might pass through the third seal surface 46 and this oil and contaminant, such as metal powder, getting into this oil flow into the low pressure chamber 41 and are temporarily collected in the low pressure chamber 41. However, these are efficiently discharged from the low pressure chamber 41 to the oil pan 43 through the communication hole 42. Therefore, an abnormal abrasion (or an abnormal wear) of each component or element of the pump configuration unit in the pump chamber 13, which occurs due to the contaminant etc., can be suppressed, and this brings about increase in durability of the pump.

Second Embodiment

Figure 7:
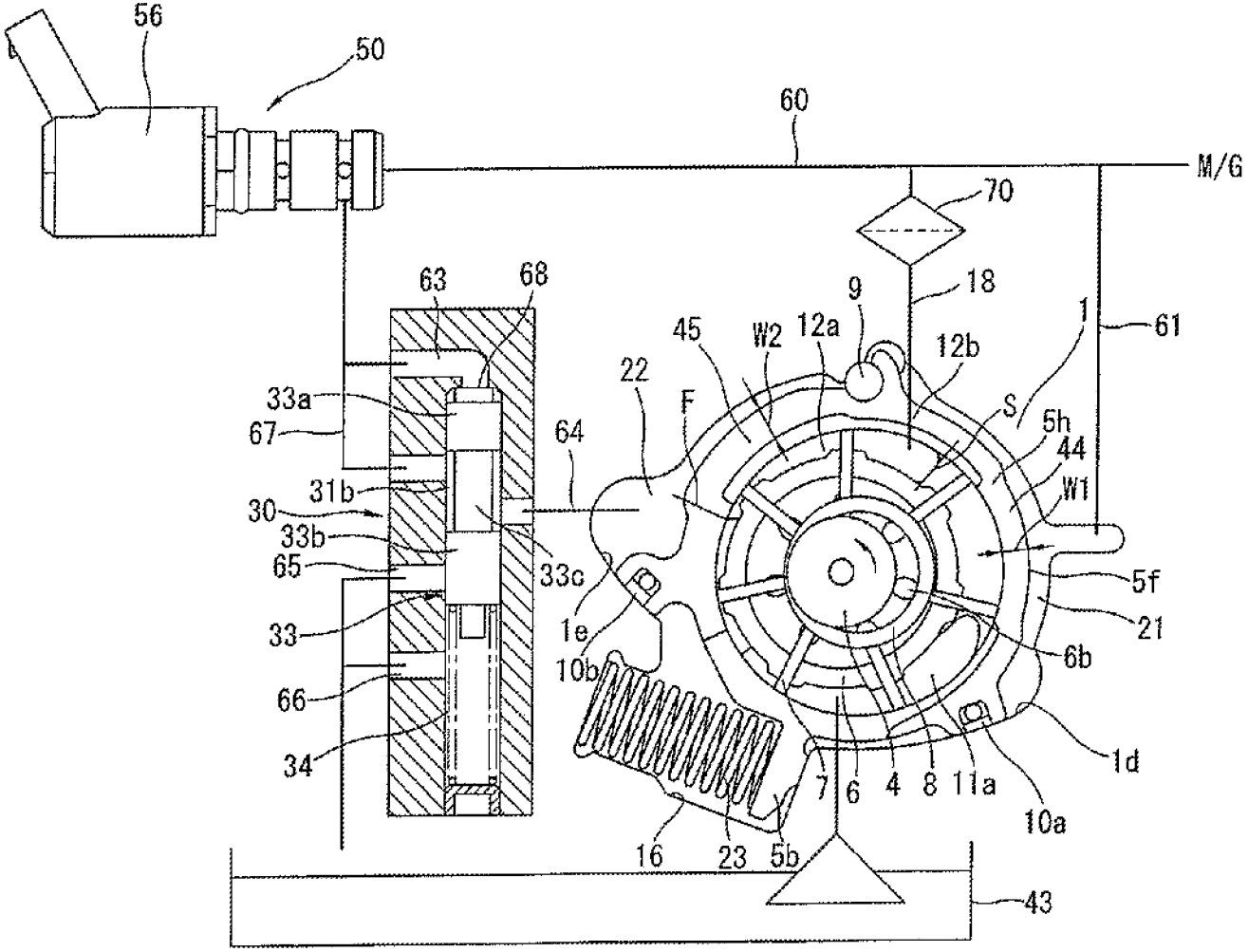
FIG. 7 is a schematic view of a variable displacement pump according to a second embodiment.

FIG. 7 shows a second embodiment. In the second embodiment, arrangement of the oil pump is reversed with respect to the first embodiment, and the rotation direction of the drive shaft 4 is a counterclockwise direction (in an arrow direction) in the drawing. Further, the low pressure chamber 41 in the first embodiment is removed. Since a basic structure or configuration of the second embodiment is the same as that of the first embodiment, the same element or component as that of the first embodiment is denoted by the same reference sign, and its explanation will be omitted.

That is, in this embodiment, the cam ring 5 is arranged in a right-and-left-reverse direction with respect to the first embodiment, and the first control hydraulic chamber 21 is located at a right side in the drawing, whereas the second control hydraulic chamber 22 is located at a left side in the drawing. Further, the inlet port 11*a* is located at a lower side in the drawing, and a part of the inlet port 11*a* overlaps the first control hydraulic chamber 21 in a radial direction. On the other hand, the outlet port 12*a* is located at an upper side in the drawing, and a large part of the outlet port 12*a* overlaps the second control hydraulic chamber 22 in the radial direction.

In addition, in this embodiment, as the outlet-side area, it is formed from a start end S up to a termination end F of the outlet port 12*a* in the rotation direction of the drive shaft 4. And, gaps or boundaries between each pump chamber 13 and the second control hydraulic chamber 22 in this area are sealed by the second seal surface 45.

Since other elements or components of the second embodiment are the same as those of the first embodiment, the same effects can be obtained. Further, since the low pressure chamber is not provided, a length of the first control hydraulic chamber 21 along the outer circumferential surface of the cam ring 5 can be extended by a size corresponding to the low pressure chamber. With this, since the area of the first pressure receiving surface 5*f*, which faces to the first control hydraulic chamber 21, of the cam ring 5 can be increased, a movement control of the cam ring 5 in the concentric direction is facilitated. It is thus possible to perform a further stable pump discharge control.

Third Embodiment

Figure 8:
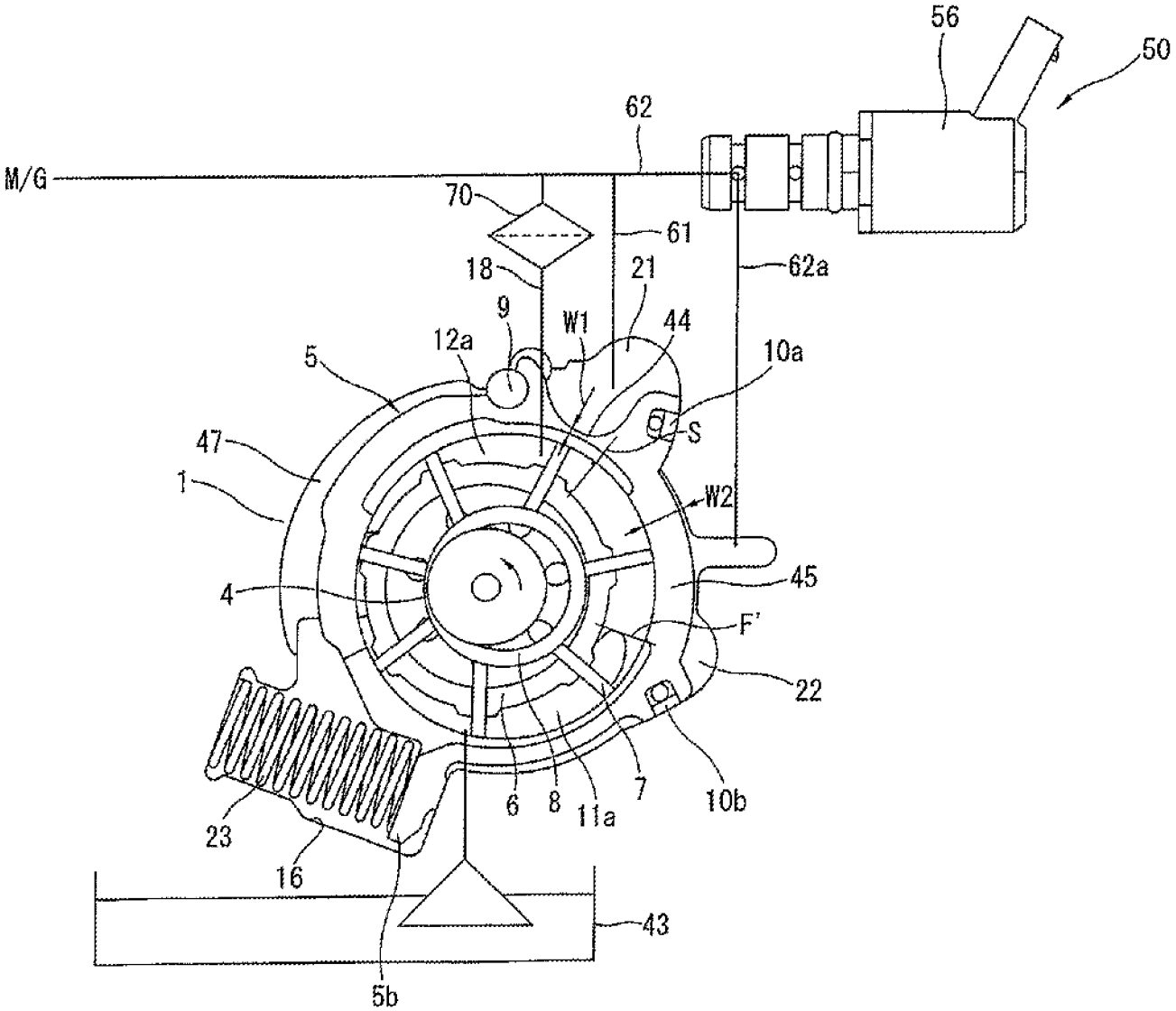
FIG. 8 is a schematic view of a variable displacement pump according to a third embodiment.

FIG. 8 shows a third embodiment. In the third embodiment, although a basic structure or configuration of the third embodiment is similar to the second embodiment, both of the first control hydraulic chamber 21 and the second control hydraulic chamber 22 are located on a right side of the pivot pin 9, and an oil chamber arranged on a left side of the pivot pin 9 is a low pressure chamber that communicates with the inlet port 11*a*. In addition, the pilot valve in the above embodiments is removed. And, a supply/discharge control of the pump discharge pressure is carried out such that the second control hydraulic chamber 22 is supplied with the discharge pressure from the downstream side passage 62*a* of the second introduction passage 62 branching off from the discharge passage 18 only through the electromagnetic switching valve 50.

The pump discharge pressure supplied to the second control hydraulic chamber 22 moves or rocks the cam ring 5 in a clockwise direction in the drawing, i.e. in the concentric direction, against a spring force of the coil spring 23 in cooperation with a pump discharge pressure of the first control hydraulic chamber 21.

On the other hand, the first control hydraulic chamber 21 is supplied with the pump discharge pressure from the first introduction passage 61, in the same manner as the above embodiments. Further, each pump chamber 13 positioned at an inner side with respect to the first control hydraulic chamber 21 through the cam ring 5 communicates with the outlet port 12*a*. Therefore, a high pressure at an early stage of compression by the pump configuration unit and the pump discharge pressure in the first control hydraulic chamber 21, which are almost equal to each other, act on inside and outside surfaces of the cam ring 5, positioned at this portion (at the inner side with respect to the first control hydraulic chamber 21), respectively.

Therefore, a radial direction width W1, between the first control hydraulic chamber 21 and each pump chamber 13 positioned at the inner side with respect to the first control hydraulic chamber 21, of the cam ring 5 is formed to be sufficiently small. That is, since the hydraulic pressures, which are almost equal to each other, act on the inside and outside surfaces of this portion of the cam ring 5, even though the radial direction width W1 of the first seal surface 44 is small, there is almost no leak of the oil from each pump chamber 13 to the first control hydraulic chamber 21.

Here, the drive shaft 4 rotates in the counterclockwise direction (in an arrow direction) in the drawing, in the same manner as the second embodiment.

In the present embodiment, as the outlet-side area, it is formed from a termination end F' of the inlet port 11*a*' up to a start end S of the outlet port 12*a*. And, a radial direction width W2 of the second seal surface 45 of the cam ring 5 in this outlet-side area is formed to be sufficiently greater than the radial direction width W1 of the first seal surface 44 on the first control hydraulic chamber 21 side.

With this, it is possible to suppress leak of the oil from each pump chamber 13 to the second control hydraulic chamber 22 in the outlet-side area.

Further, the radial direction width W2 of the second seal surface 45 of the cam ring 5 is large, while the radial direction width W1 of the first seal surface 44 is small. Thus, it is possible to suppress an increase in weight of the whole of the pump, which is the same as the above embodiments.

The present invention is not limited to the above embodiments. For instance, as the outlet-side area, unlike the above embodiments, it could be formed from a termination end F of the outlet port 12*a* up to a start end S' of the inlet port 11*a* in the rotation direction of the rotor 6.

Further, in the above embodiments, correlation or comparison between the radial direction widths W1 and W2 of the first and second seal surfaces 44 and 45 (46) is indicated using the average radial direction widths. However, the radial direction widths W1 and W2 could be set using maximum radial direction widths or minimum radial direction widths.

Furthermore, in the above embodiments, the communication hole 42 communicates with the oil pan 43 (the atmospheric air) that is a low pressure side. However, the communication hole 42 could communicate with the inlet hole 11*c* side where a suction negative pressure is generated.

Moreover, the low pressure chamber 41 is formed into a relatively large-sized arc shape by the hollow groove 40. However, the size of the low pressure chamber 41 can be small as long as the contaminant flows into and is collected in the low pressure chamber 41.

A mounting direction of the pump housing onto the cylinder block of the engine is arbitrarily determined. It can be freely changed depending on a size of the engine or specifications of the engine.

The above embodiments show that the discharge amount can be varied by the movement or the rock of the cam ring 5. However, a discharge amount changing manner is not limited to this. For instance, the discharge amount could be varied by a linear movement of the cam ring 5 in the radial direction.

In the above embodiments, a vane pump is used as the oil pump. However, as the oil pump, a gear pump could be used.

As the variable displacement pump based on the embodiments explained above, for instance, the followings are raised.

As one aspect of the present invention, a variable displacement pump comprises: a rotor that is driven and rotates; a plurality of vanes that are provided at an outer circumferential portion of the rotor so as to be able to extend and retract; a ring-shaped movable member that defines a plurality of working fluid chambers by accommodating the rotor and the plurality of vanes at an inner circumferential side of the movable member and changes a volume variation of each working fluid chamber during rotation of the rotor by moving so that an inner circumferential center of the movable member changes with respect to a rotation center of the rotor; a pump housing that houses therein the rotor, the vanes and the movable member, both axial direction end surfaces of the movable member being in sliding-contact with both opposing inside surfaces of the pump housing; an inlet section that is formed on at least one of the both inside surfaces of the pump housing and opens in an inlet-side area where a volume of each working fluid chamber is increased by the rotation of the rotor; an outlet section that is formed on at least one of the both inside surfaces of the pump housing and opens in an outlet-side area where the volume of each working fluid chamber is decreased by the rotation of the rotor; a first control hydraulic chamber that, by an internal pressure thereof generated by being supplied with a discharge pressure discharged from the outlet section, gives a force to the movable member in a direction in which the volume variation of each working fluid chamber is decreased; a second control hydraulic chamber that, by supply and discharge of the discharge pressure and interruption of the supply of the discharge pressure which are selectively switched by a switching mechanism, gives a force to the movable member in a direction in which the volume variation of each working fluid chamber is changed; a first seal part that is formed on the both end surfaces of the movable member, which are in sliding-contact with the both inside surfaces of the pump housing, and seals a gap between each working fluid chamber and the first control hydraulic chamber; and a second seal part which is formed on the both end surfaces of the movable member and seals a gap between each working fluid chamber and the second control hydraulic chamber in the outlet-side area, and whose radial direction width is greater than a radial direction width of the first seal part.

As a preferable aspect of the variable displacement pump, the second control hydraulic chamber gives the force to the movable member in a direction in which the volume variation of each working fluid chamber is increased by a discharge pressure supplied from the outlet section.

As another preferable aspect of the variable displacement pump, an average radial direction width of the second seal part is greater than an average radial direction width of the first seal part.

As another preferable aspect of the variable displacement pump, a minimum radial direction width of the second seal part is greater than a minimum radial direction width of the first seal part.

As another preferable aspect of the variable displacement pump, a maximum radial direction width of the second seal part is greater than a maximum radial direction width of the first seal part.

As another preferable aspect of the variable displacement pump, the inlet section and the outlet section are each formed into an arc shape along a moving direction of the movable member. The outlet-side area is formed at an area from a termination end of the inlet section to a termination end of the outlet section in a rotation direction of the rotor. A radial direction width of the second seal part that seals a gap between each working fluid chamber and the second control hydraulic chamber at the outlet-side area is greater than the radial direction width of the first seal part.

As another preferable aspect of the variable displacement pump, the movable member is a cam ring that increases and decreases the volume variation of each working fluid chamber by rocking on a rocking fulcrum.

As another preferable aspect of the variable displacement pump, the variable displacement pump further comprises a third control hydraulic chamber that is formed between the rocking fulcrum of the movable member and the first control hydraulic chamber and communicates with a low pressure side. And, a radial direction width of a third seal part that is formed on the both end surfaces of the movable member and seals a gap between each working fluid chamber and the third control hydraulic chamber in the outlet-side area is greater than the radial direction width of the first seal part.

As another preferable aspect of the variable displacement pump, the radial direction width of the second seal part is substantially 3.5 mm or greater.

As another preferable aspect of the variable displacement pump, the outlet-side area is formed at an area from a start end to a termination end of the outlet section in a rotation direction of the rotor.

As another preferable aspect of the variable displacement pump, the outlet-side area is formed at an area from a termination end of the outlet section to a start end of the inlet section in a rotation direction of the rotor.

As another preferable aspect of the variable displacement pump, the outlet-side area is formed at an area from a termination end of the inlet section to a start end of the outlet section in a rotation direction of the rotor.

Further, as one aspect of the present invention, a variable displacement pump comprises: a pump housing that houses, in a pump accommodation chamber thereof, a pump configuration unit that discharges, from an outlet section, working fluid sucked from an inlet section by change of volumes of a plurality of pump chambers; a movable member that is provided in the pump accommodation chamber and changes a volume variation of each pump chamber by moving; a first control hydraulic chamber that, by being supplied with the working fluid discharged from the outlet section, gives an urging force to the movable member in a direction in which the volume variation of each pump chamber is decreased; a second control hydraulic chamber that, by supply and discharge of the working fluid from the outlet section through a passage and interruption of the supply of the working fluid which are selectively switched, controls the movable member in a direction in which the volume variation of each pump chamber is changed; a control mechanism that controls supply and discharge of a hydraulic pressure to and from the second control hydraulic chamber according to a discharge pressure of the working fluid from the outlet section; a switching mechanism that is provided on a control pressure introduction passage formed between the control mechanism and the outlet section and controls switch of introduction of the discharged working fluid to the control mechanism side; a first seal part that is formed on both end surfaces of the movable member, which are in sliding-contact with both opposing inside surfaces of the pump housing, and seals a gap between each pump chamber and the first control hydraulic chamber at the inlet section side; and a second seal part that is formed on the both end surfaces of the movable member, which are in sliding-contact with the both opposing inside surfaces of the pump housing, and seals a gap between each pump chamber and the second control hydraulic chamber at the outlet section side, and a leak amount of the working fluid leaking from each pump chamber to the second control hydraulic chamber through the second seal part at the outlet section side is smaller than a leak amount of the working fluid leaking from each pump chamber to the first control hydraulic chamber through the first seal part at the inlet section side.

As another preferable aspect of the variable displacement pump, a radial direction width of the second seal part of the movable member is greater than a radial direction width of the first seal part.

The invention claimed is:

1. A variable displacement pump comprising:

a pump configuration unit that is structured to suck and discharge oil by being driven and rotating;

a ring-shaped movable member that defines a plurality of working fluid chambers by accommodating the pump configuration unit at an inner circumferential side of the movable member and changes a volume of each working fluid chamber by moving;

a pump housing that houses therein the pump configuration unit and the movable member, both axial direction end surfaces of the movable member being in sliding-contact with both opposing inside surfaces of the pump housing;

an inlet section that is formed on at least one of the both inside surfaces of the pump housing and opens in an inlet-side area where the volume of each working fluid chamber is increased by the rotation of the pump configuration unit, wherein the pump configuration unit sucks the oil from the inlet section;

an outlet section that is formed on at least one of the both inside surfaces of the pump housing and opens in an outlet-side area where the volume of each working fluid chamber is decreased by the rotation of the pump configuration unit, wherein the pump configuration unit discharges the oil from the outlet section;

wherein a flow amount of the oil discharged from the outlet section is changed by the movement of the movable member, a first control hydraulic chamber that, by an internal pressure thereof generated by being supplied with the oil discharged from the outlet section, gives a force to the movable member in a direction in which the flow amount of the oil discharged from the outlet section is decreased;

a second control hydraulic chamber that, by being supplied with the oil discharged from the outlet section by a switching mechanism, gives a force to the movable member in a direction in which the flow amount of the oil discharged from the outlet section is increased, and that, by the oil in the second control hydraulic chamber being discharged by the switching mechanism, gives a force to the moveable member in a direction in which the flow amount of the oil discharged from the outlet section is decreased;

a first seal part that is formed on at least one of the both end surfaces of the movable member, which are in sliding-contact with the both inside surfaces of the pump housing, and seals a gap between each working fluid chamber and the first control hydraulic chamber; and a second seal part that is formed on at least one of the both end surfaces of the movable member and seals a gap between each working fluid chamber and the second control hydraulic chamber in the outlet-side area, wherein the second seal part has, throughout the outlet-side area, a radial direction width from the second control hydraulic chamber to each working fluid chamber in the outlet-side area which is greater than a radial direction width of the first seal part from the first control hydraulic chamber to each working fluid chamber in the inlet-side area.

2. The variable displacement pump as claimed in claim 1, wherein:

the second control hydraulic chamber gives the force to the movable member in a direction in which the volume variation of each working fluid chamber is increased by a discharge pressure supplied from the outlet section.

3. The variable displacement pump as claimed in claim 1, wherein:

an average radial direction width of the second seal part is greater than an average radial direction width of the first seal part.

4. The variable displacement pump as claimed in claim 1, wherein:

a minimum radial direction width of the second seal part is greater than a minimum radial direction width of the first seal part.

5. The variable displacement pump as claimed in claim 1, wherein:

a maximum radial direction width of the second seal part is greater than a maximum radial direction width of the first seal part.

6. The variable displacement pump as claimed in claim 1, wherein:

the outlet-side area is formed at an area from a termination end of the inlet section to a termination end of the outlet section in a rotation direction of the rotor.

7. The variable displacement pump as claimed in claim 1, wherein:

the outlet-side area is formed at an area from a start end to a termination end of the outlet section in a rotation direction of the rotor.

8. The variable displacement pump as claimed in claim 1, wherein:

the outlet-side area is formed at an area from a termination end of the outlet section to a start end of the inlet section in a rotation direction of the rotor.

9. The variable displacement pump as claimed in claim 1, wherein:

the outlet-side area is formed at an area from a termination end of the inlet section to a start end of the outlet section in a rotation direction of the rotor.

10. The variable displacement pump as claimed in claim 1, wherein:

the movable member is a cam ring that increases and decreases the volume variation of each working fluid chamber by rocking on a rocking fulcrum.

11. The variable displacement pump as claimed in claim 10, further comprising:

a third control hydraulic chamber that is formed between the rocking fulcrum of the movable member and the first control hydraulic chamber and communicates with a low pressure side, and wherein a radial direction width of a third seal part that is formed on the both end surfaces of the movable member and seals a gap between each working fluid chamber and the third control hydraulic chamber in the outlet-side area is greater than the radial direction width of the first seal part.

12. The variable displacement pump as claimed in claim 2, wherein:

the radial direction width of the second seal part is substantially 3.5 mm or greater.

13. The variable displacement pump as claimed in claim 1, further comprising:

a control mechanism that controls supply and discharge of a hydraulic pressure to and from the second control hydraulic chamber according to a discharge pressure of the working fluid from the outlet section.

14. The variable displacement pump as claimed in claim 1, wherein:

an area of a pressure receiving surface, on the second control hydraulic chamber side, of the moveable member is larger than an area of a pressure receiving surface, on the first control hydraulic chamber side, of the moveable member.

* * * * *